US006315066B1

(12) United States Patent
Dennis

(10) Patent No.: US 6,315,066 B1
(45) **Date of Patent: *Nov. 13, 2001**

(54) MICROWAVE SINTERED TUNGSTEN CARBIDE INSERT FEATURING THERMALLY STABLE DIAMOND OR GRIT DIAMOND REINFORCEMENT

(76) Inventor: Mahlon Denton Dennis, 2020 Rankin Rd., Houston, TX (US) 77073

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/156,838

(22) Filed: Sep. 18, 1998

(51) Int. Cl.[7] ..... E21B 10/36
(52) U.S. Cl. ..... 175/431; 175/432; 408/145
(58) Field of Search ..... 125/426, 431, 125/432, 433, 434; 408/145

(56) References Cited

U.S. PATENT DOCUMENTS

| | | | | |
|---|---|---|---|---|
| 5,199,832 | * | 4/1993 | Meskin et al. | 175/434 |
| 5,205,684 | * | 4/1993 | Meskin et al. | 175/434 |
| 5,217,081 | * | 6/1993 | Waldenstrom et al. | 175/433 |
| 5,524,719 | * | 6/1996 | Dennis | 175/434 |

* cited by examiner

*Primary Examiner*—William Neuder
(74) *Attorney, Agent, or Firm*—Munsch Hardt Kopf & Harr, P.C.

(57) ABSTRACT

The present disclosure sets out a method and apparatus for forming an insert body. The insert body is preferably made of hard particles of tungsten carbide commingled with particles of a binding metal alloy primarily made of cobalt. The finished component typically is a right cylinder of tungsten carbide and cobalt based alloy. It incorporates in it a diamond region which is formed of diamond particles and cobalt also. The geometry of the diamond region is preferably a sphere or a cylinder and has a curvilinear bottom face to distribute stress for structural integrity.

34 Claims, 4 Drawing Sheets

MICROWAVE SINTERED TUNGSTEN CARBIDE INSERT FEATURING THERMALLY STABLE DIAMOND OR GRIT DIAMOND REINFORCEMENT

BACKGROUND OF THE DISCLOSURE

This disclosure is directed to an insert which is an advance over well known tungsten carbide inserts used here before. The insert of the present disclosure utilizes a tungsten carbide (or WC) body. This adherent body is made from a shaped and molded mass of tungsten carbide particles which are held together by a cobalt based metal alloy binder. The cobalt based alloy is distributed throughout the body. It adheres to and forms a bond with the tungsten carbide particles distributed evenly throughout the body. This enables the construction and fabrication of a solid, rugged, long life wear part. It can take substantial impact and is able to resist wear readily. The shock impact is handled well by this device. One well known problem of tungsten carbide inserts however is that they wear on the face which makes contact with moving parts. More importantly, such faces have been protected in the past by the incorporation of a wear layer. One technique has been the incorporation of a cap which has been polycrystalline diamond compact (or PDC) material. This unitary body has been adhesively joined typically by a braze layer or other techniques. That has met with real success. There are however some limitations to the use of that two component system. There is the serious tendency of shearing at the interface. This interface is normally the braze area. The interface is susceptible to one set of shear forces which are formed across that interface region merely by the fabrication of the product. Fabrication involves construction of the insert using the cast tungsten carbide body with an integrally formed or later attached cap after separate manufacture. In all instances, there are difficulties arising from the stress in the braze bond plane.

SUMMARY OF THE INVENTION

The present disclosure is directed to an insert which is made of tungsten carbide and which is reinforced with thermally stable diamond (TSP) and in some cases dispersed diamond grit particles also. In this instance, the TSP is fabricated in the form of a cylinder which is placed in the insert body. The cylinder is located at an angle with respect to the common stresses applied to the insert body. By doing this, the finished structure is supported and structurally reinforced by the TSP insert. A TSP component formed as a cylinder is especially beneficial because it is easily gripped by the surrounding body. The TSP reinforced insert construction then has better distribution of stresses. That is, stresses which originate at the time of fabrication do not become so severe that they create problems. Stresses which are encountered in the dynamics of use do not pose a problem. Finally, stresses which derive from impact are handled more readily to prevent shattering the TSP. The TSP provides the composite structure in the insert which is able to provide reinforcement, longer life and better resistance to both shock loading and steady state stresses. In this aspect the insert of the present disclosure is especially beneficial in that the structure substantially grips the TSP fully around and holds it in place. The TSP component when held in this fashion provides much longer life to the composite insert made by the present process. The TSP shape will be discussed in detail later.

Consider now the situation which arises after this insert has been used for a long while. The insert use normally entails wearing from one end. The wear applied to the insert grinds away the exposed end. As it is abraded, it is ground and polished time and time again. Eventually, wearing away the WC body exposes the TSP. The TSP is also worn away and exposed. Eventually, the internal TSP will form an exposed island at the end face where wear occurs. This continues indefinitely. Even while this gradual wear occurs, there is no particular problem arising from this accumulated wear because the accumulation of wear does not prompt the device to shatter or break in an unintended fashion. Moreover there is little likelihood of TSP separation.

In one aspect of the present disclosure a drawing die is disclosed. The drawing die is especially beneficial for converting bar stock into drawn wire. The metal is forced through the die and is deformed. The bulk of the wear of the die made with an insert of TSP within a surrounding WC body is handled readily by this improved drawing die. The common risk to this sort of drawing die is that the diamond insert, of a multitude of shapes, tends to pull free from the surrounding WC body. It is somewhat like unnesting a stack of cups or cones. The force applied to the die cutter of diamond material typically initiates that kind of failure mode. It will operate successfully for a while and then the die cutter diamond component will either pull free or break into a few large pieces on release of the grip by the surrounding strong or re-reinforced body. In all instances, that poses a serious problem of catastrophic failure.

The present disclosure sets forth a diamond drawing mechanism which is able to endure that kind of wear and tear without that kind of catastrophic failure. While it not only lasts longer, it lasts longer with greater durability and less likelihood of failure in that mode. The diamond insert that is on the interior of the drawing die is gripped and held by the surrounding WC body so that release does not accidentally occur. The common failure mode in this instance is defeated.

The insert for the present disclosure of a drawing die is made of TSP which is surrounded in a WC body. A suitable drilled hole of appropriate diameter is formed. The hole is drilled through the die typically along the center line axis. The hole however passes through the TSP which is surrounded by the WC body. The TSP has the form of an elongate cylinder. The hole through the cylinder is at right angles so that the cylinder is gripped by the surrounding body.

After long use of the drawing die, the accumulated wear and tear on this construction eventually enlarges the gauge of the hole but it is less likely to cause a complete failure of the die.

Finally the present disclosure sets out a construction of an insert where two or more of the TSP cylinders are placed in the insert body. This provides separate wear pads when they finally erode, thereby exposing the TSP at two different locations. Last of all, the TSP cylinder is protected by scattering a few separate diamonds in the near vicinity of it. These cause redistribution of stress patterns in the WC support body which makes up the bulk of the insert.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

Figure 1:
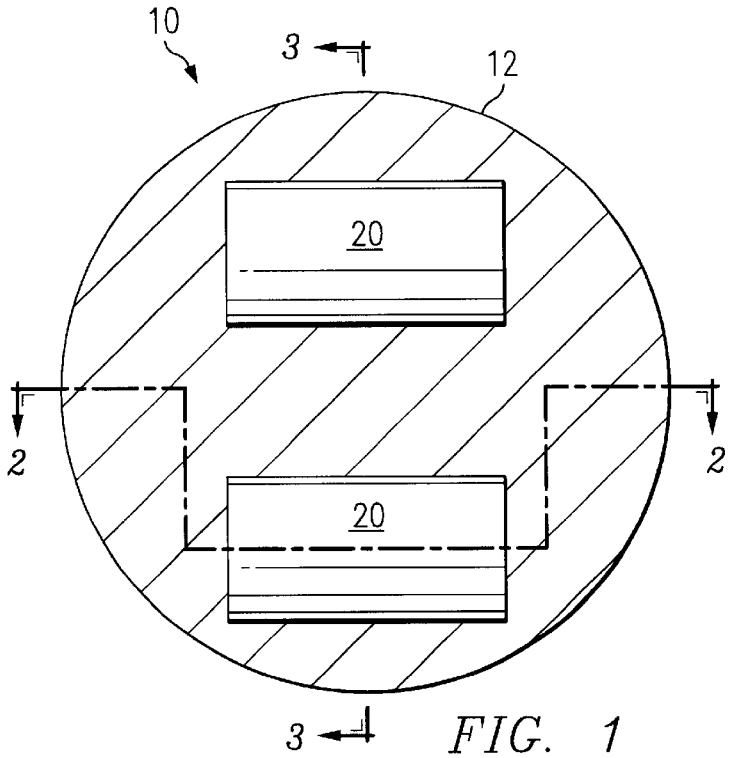
FIG. 1 is a plan view of a circular insert construction including spaced thermally stable diamond cylinders positioned therein and integrally cast with the insert.

Attention is directed to FIG. 1 of the drawings where the number 10 identifies the insert construction of the present disclosure. The insert 10 comprises an elongate cylindrical body formed of tungsten carbide (WC below). The tungsten carbide body 12 is a solid member formed or cast in a manner to be forth. In most applications, it is constructed as a right cylinder having a specified height and diameter. Versions will be discussed below where it is a truncated cone shape. The tungsten carbide body is formed of WC particles. While other materials can be used such as CBN, WC is the preferred form. It is supplied in a mix of granular sizes. The WC particles are sharply fractured, angular and relatively hard. The particles best have a random size so that they are typically screened by a range of meshes. They range from just a few microns up to perhaps 500 to 1000 microns. While larger particles can be used, it is desirable in general terms that they be provided in a mix so that the random distribution of the particles in the cast body enables a relatively smooth and void free construction to be made. At the preliminary stage, the particles are mixed and cold pressed to the form or shape that is shown in the drawings.

The WC particles make up about 75 to 94 percent of the body. The remainder of the body is formed of a tungsten cobalt alloy. This cobalt alloy is somewhere from as low as about 6 to about 25 percent of the body. The preferred WC ratio is about 91 or 92 percent WC while the remainder is the alloy. On heating, the tungsten carbide particles are held together with the supportive alloy matrix. They can be sintered in a conventional heating (with pressure) process, or they can be joined together in a microwaving process. The alloy is thus mixed with the WC particles. On sintering, the alloy melts and adheres to the WC particles so that the bonded result is a well joined adherent structure. The preferred alloy is primarily cobalt alloyed with other metals. The cobalt portion is usually about 80% to about 96% of the alloy. By application of appropriate preliminary pressures, the body is packed so that there are substantially no voids in its fabrication. After sintering, the body has the requisite strength, hardness, structural integrity, and yet is sufficiently yieldable that it can work well in high impact high stress conditions. It especially finds use in cutters such as inserts mounted on the cones of a rotary cone drill bit.

In another aspect, the present disclosure sets out an insert body which is constructed with the end face 14, the side face 16 and a lower end which normally is parallel to the top face 14. At the time of fabrication, the insert which is constructed to some desired diameter is cold pressed in a mold or cavity. It is protected by the insertion typically of one, two or three thermally stable diamond cylinders. These are shown at 20. The preferred form includes two of the TSP diamond cylinders. The diamond cylinders are formed of two commingled sets of particles, one being particles of diamond and the other being a cobalt based alloy which again serves as a binder or supportive matrix. More specifically, the cylinders are formed as elongate right cylinders as illustrated. In one approach, they are formed separately and made to the requisite hardness and thereafter placed in molds where the WC body is built around them. In other words, this involves a two step process, the first making the TSP to the requisite form and the second making the WC body with the TSP located in it. Consider the process of making the TSP as a separate step. Diamond particles over a range of sizes are molded in a cylindrical mold. The particles have a range of sizes. The sizes range from the smallest that is available up to about 1000 microns. They are mixed in a random fashion. They are commingled with particles of a cobalt based alloy binder. The amount of cobalt in the binder is somewhere between about 85 and 96 percent. The remainder of the alloy is comprised of other metals. The metal alloy is provided in small particles commingled evenly in the mold where the TSP is fabricated. By application of heat, the cobalt based binding metal is melted and bonds to the diamonds, holding them in a structure of fixed shaped and size. The TSP becomes a unitary body which thereafter has the wear characteristics of diamond. While diamond has a hardness of 10.0 on a relative scale and is the hardest material available to mankind, the assembled TSP approaches that. This enables the use of industrial grade diamonds in fabrication of the structure.

Care should be observed in the fabrication of the TSP. Diamond is a form of carbon which can chemically convert to other forms of carbon. If actually combusted, it will convert to $CO_2$, or if exposed to elevated heat without combustion, it may convert to useless forms of carbon such as graphite. All such conversions are undesirable. Because they are undesirable, it is best to avoid that kind of risk. At the stage of fabrication of the TSP, the maximum temperature is limited. It must be high enough to prompt the alloy to melt and to cause the metal in the alloy to form a bond with the diamond. On the other hand it must be low enough to avoid the problems of combustion or conversion as noted above. In part, this is a temperature dependent process, but it is also driven by the duration of the process. The manufacturing process preferably involves sintering to convert the loose diamond into the assembled TSP. At the time of assembly it is shaped in a mold which is then exposed to appropriate heat for conversion. In the longer used HPHT process, there is the risk that the lengthy time at elevated temperature will convert some or perhaps all of the diamond into the undesirable chemical forms. Preferably, the TSP of the present disclosure is molded to the desirable cylindrical size and shape and is converted into the solid shape desired by microwave sintering. Microwave conversion involves only a short interval of heating. Moreover, since the EMF radiation prompts internal heating (not external heating), the temperature moves quickly to the desired level but does not require long time spans, thereby providing a more easily controlled process. Suffice it to say, the TSP is then fabricated to the desired size and shape.

A two step process can be undertaken, the first being separate fabrication of the TSP and the second step involving the subsequent casting of the body 12 which surrounds the TSP on the interior. A single step process is also taught herein. The TSP is formed by commingling the diamond particles, the metal alloy particles and mixing them with a wax which is a sacrificial adhesive. Thereafter, that green TSP member is placed in the mold with the WC particles. That mold is filled to capacity and is cold pressed. By assembling in this fashion, the wax holds the TSP components together. Those are surrounded by other components which are still loose and not yet consolidated. At the stage of microwave sintering, the entire mass is heated and sintered. This will effectively form a unitary body with a single heating. The single step sintering process provides the desired internal structural integrity and reinforcement within the insert 10.

Figure 2:
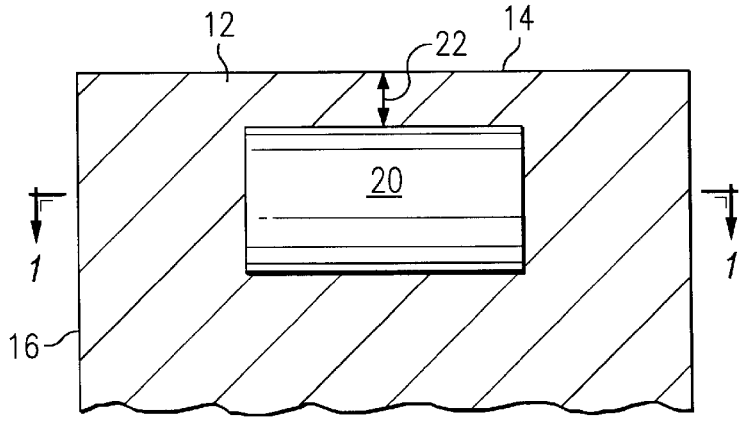
FIG. 2 is a sectional view taken along the line 2—2 of FIG. 1 showing the location of the TSP cylinder within the insert body.
Figure 3:
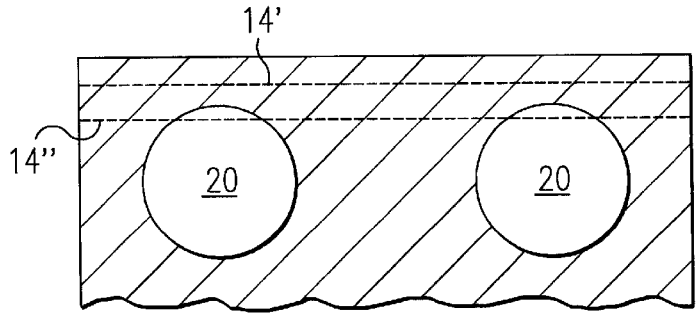
FIG. 3 is a sectional view taken along the line 3—3 of FIG. 1 showing side by side positioning of the two TSP cylinders.

Going now to the geometry of this structure shown in FIG. 1, the WC insert body 12 will be described generally as the insert. As noted, it is commonly elongate and cylindrical. Moreover it is formed with an exposed end face 14 in a region or area which is commonly exposed to wear and tear. Reinforcement of that region becomes important. The TSP 20 of this disclosure is formed into a cylinder. This will be described as the reinforcing cylinder (RC below). The RC is normally formed into an elongate right cylinder. It is not mandated that the end faces of the RC be precisely square at the corners. Rounding at the corners is tolerated, and in some instances, it is specifically designed in the shape of the RC. The RC 20 shown in each of FIGS. 1, 2 and 3 are completely submerged in the WC body 12. There is a space or gap 22 between the end face 14 and the RC 20 in the structure. This gap region is provided so that it can be worn away during use. It wears away, perhaps evenly and perhaps with a cant or tilt at one side of the other of the insert body 12. As wear continues, the face 14 becomes the face 14' shown in FIG. 3. Eventually, with greater accumulated wear, the end face 14 shown in FIG. 2 becomes the end face 14". The face 14" shows how wearing of the insert body 12 cuts into the body and eventually exposes the RC 20. That also is worn away. The insert 20 is then exposed after more wear and tear. The RC provides a pad or island in the middle of the end face 14 located by the geometry of the RC construction and position. Because there are two of the submerged cylinders 20, two small islands will eventually appear. As they become more and more exposed, they reduce the rate of wear because the provide a harder reinforced region. This hardness of the two is effective to prevent faster wear. Indeed, as the wear region approaches the diameter of the cylinders 20, the exposed diamond area becomes greater and the rate of wear is reduced.

One advantage of the structures shown in FIGS. 1, 2 and 3 is the controlled rate of wear. Wearing down to the level shown in FIG. 3 which exposes the diamond on the interior is a benefit of extended life. Moreover it is associated with a more durable structure which is more readily able to resist routine grinding wear as well as shock loading. In part, this relates to the different distribution of stress on the interior of the WC insert body. Elaborating, internal stresses within the body are handled in a better fashion. The internal stresses are distributed differently as a result of the RC located in the insert 10. With the two that are illustrated, wear and tear and the related stress are significantly altered by the RC on the interior. Assume for the moment that loading is applied evenly across the face 14. A compressive stress on the end face is distributed evenly across the area. Ordinarily, that occurs but it is usually accompanied with a shear force across the plane of the end face. That also is accommodated by the RC on the interior. Because the loading, creates stresses dynamically within the insert 10, the RC on the interior helps maintain structural integrity against the heavy load.

Figure 4:
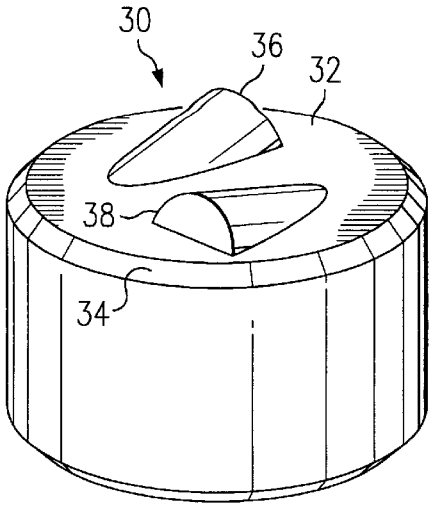
FIG. 4 is a perspective view of a modification of the insert construction shown in FIG. 1 wherein two TSP cylinders are located near the top surface and are positioned at angles to enable the TSP to provide a certain area or region on the exposed face.

The most common construction is that shown and discussed to this point. An alternate construction is now illustrated in FIG. 4. There, the insert 30 is constructed with the RC at the end face 32. In this instance, the end face 32 is slightly chamfered. The chamfer 34 is located fully around the face 32. The TSP components 36 and 38 are located at canted angles. This defines, in plan view, regions which are approximately triangular in shape and formed of exposed diamond (TSP). In use, the protrusion will wear away more readily and quickly. Indeed, after fabrication and dressing by the use of an appropriate grinding device, the protruding components can be smoothed down flush with the end face 32.

Figure 5:
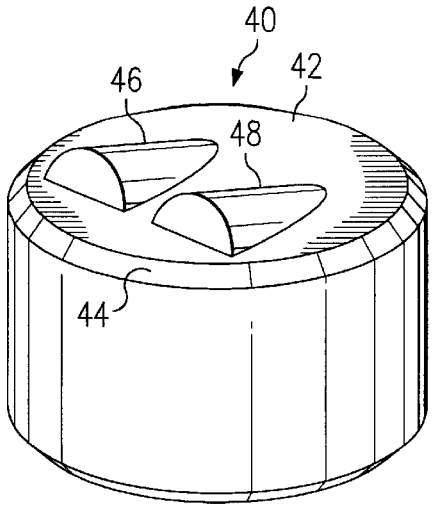
FIG. 5 is a view similar to FIG. 4 showing an alternate position of the two TSP cylinders.

Whether done at the time of fabrication or done in use, the two TSP components 36 and 38 eventually have the form of triangular regions of extreme hardness located in the WC body. In FIG. 5 of the drawing, the embodiment 40 again includes the end face 42 and the appropriate surrounding chamfer 44. The diamond component 46 and the second diamond component 48 are located at canted angles, again with a small portion protruding above the surface. In this instance, the two triangles which are formed after grinding away of the protrusions have the shape of adjacent diamond regions. The two exposed diamond regions again are triangular, but they are oriented differently. The components 30 and 40 typically are used in different circumstances. For instance, the insert 40 can be used in a drag bit. A drag bit involves a different kind of movement across the end face of a well borehole. The direction of abrasion across the exposed end face 42 is different in contrast with the embodiment 30. Accordingly, the embodiments 30 and 40 both accommodate wear in different manners.

AN ALTERNATE EMBODIMENT

Figure 6A:
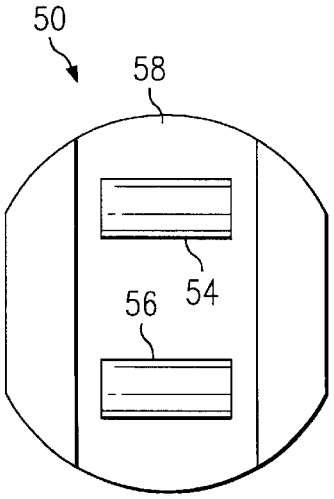
FIGS. 6A, 6B and 7 together show orthogonal views of a tapered insert body for a drill bit supporting the TSP therein.
Figure 6B:
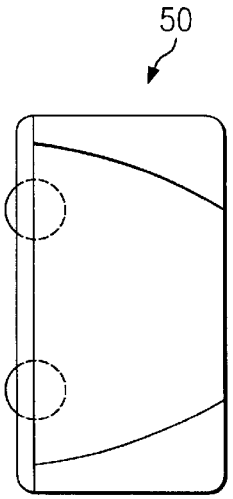
Figure 7:
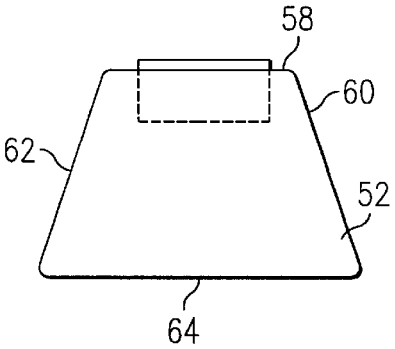

In FIGS. 6A, 6B and 7 considered jointly, the embodiment 50 illustrates a tapered WC body 52 having a pair of parallel TSP cylinders inserts therein. The TSP cylinders integrally formed in the structure are identified at 54 and 56. They comprise right cylinders which are arranged in parallel fashion and are deployed with parallel axes. They are located on the exposed end face 58 which is between the tapered side faces 60 and 62. The insert is formed of a right cylinder where the top face 58 is parallel to the bottom face 64. By truncation, the two side faces 60 and 62, better shown in FIG. 7, define the tapered crowned insert 50 which is installed in a drill bit. The drill bit construction utilizes the reduced end face dimension to advantage, namely, directing substantially all the wear and tear to the TSP exposed at the two areas as shown in the plan view of FIGS. 6A and 6B.

This type construction assures longer life. Moreover the TSP accomplishes the intended purpose of handling wear and tear in a more orderly fashion.

Figure 8:
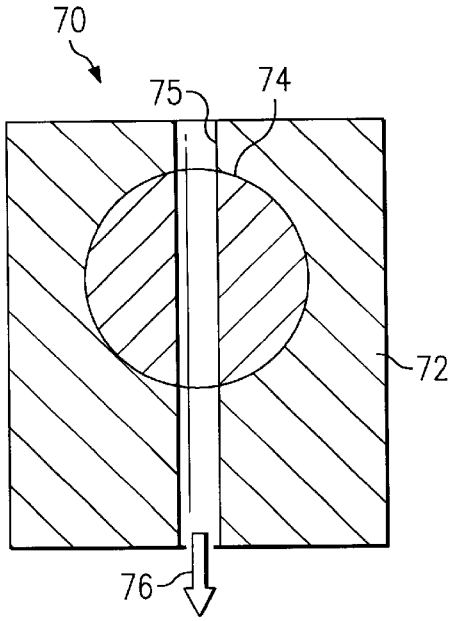
FIG. 8 is a diametric sectional view through the body and TSP located therein for a wire drawing die.
Figure 9:
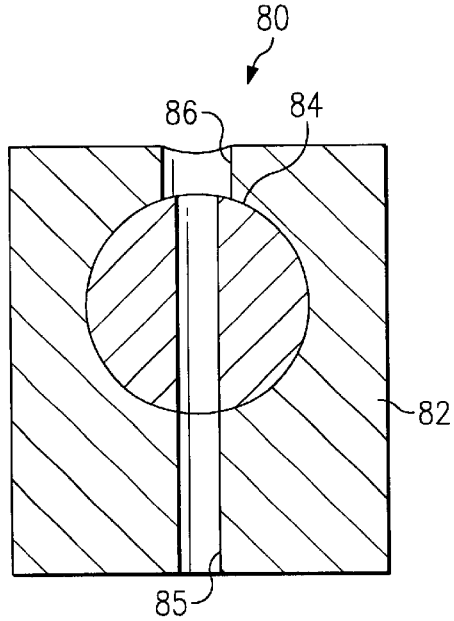
FIG. 9 is an alternate view of the drawing die shown in FIG. 8.

Attention is now directed to FIG. 8 of the drawings where the numeral 70 identifies a drawing die for wire manufacture. First, it comprises an elongate WC body 72 having a passage 75 through it. The passage is for drawing rod stock down to a wire size. The rod stock is provided to a specified diameter. It is pulled through the die at the passage 75. This reduces the diameter, and converts the larger diameter rod into a smaller diameter member. In the metal working which occurs in the die extrusion process, the draw down to the smaller diameter converts the rods into wire. This is a fabrication step which routinely inflicts tremendous wear and tear on the die. It causes substantial heating. With elevated temperatures and tremendous stress in the die. The common die construction utilizes an outside body surrounding a diamond which is penetrated with the die passage. The diamond on the interior tends to pull away. This embodiment is an improved drawing die construction using a tungsten carbide body with the insert 74 formed of TSP on the interior. It is preferably a sphere or round rod. As before, it is formed with a bottom side which is part of a cylinder or sphere. This curving area, a relatively large cross sectional area, remains in place notwithstanding the impact of wire drawing. The arrow 76 identifies the downward direction of wire drawing. It is a source of constant wear. The passage 72 will otherwise be worn to a larger diameter. Catastrophic failure typically occurs from wearing, with portions of the die breaking away and being pulled free from the bottom. This construction supports the hard components 74 in the surrounding bodies 72 so that this type failure is markedly reduced. FIG. 9 shows another embodiment. There, the embodiment 80 incorporates the drawing passage 85 modified to a larger diameter at 86. In effect, a larger diameter rod is inserted into that opening. This guides the rod stock against the cutting edge of the die. Again the diamond having the form of TSP is incorporated fully surrounded in the body. The TSP 84 is supported by the body 82. Stresses applied to the TSP 84 do not pose a problem because they are widely distributed and transferred out of that body and into the WC body 82.

Figure 10:
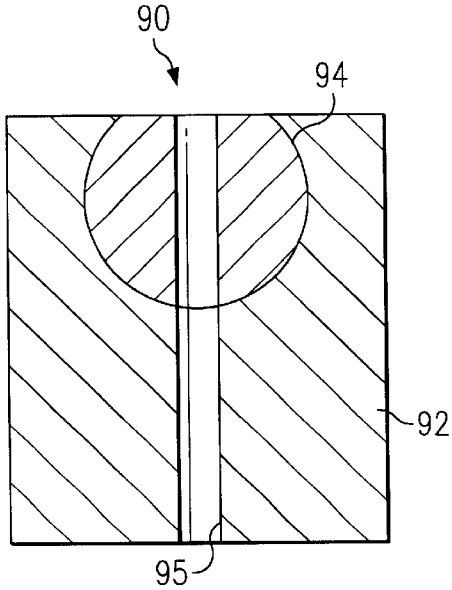
FIG. 10 is another view of the drawing die showing a modified location of the TSP within the drawing die.

The embodiment 90 shown in FIG. 10 is different in another aspect. There, the body 92 supports the TSP 94. As before, it has the shape of a sphere or right cylinder. This defines a relatively large footprint so that the loading on it is applied across the larger body 92 and is widely distributed. The die forming passage 95 again is incorporated. The wire is drawn through the passage 95. It enters at the TSP which is elevated in the embodiment 90 compared with the embodiments 70 and 80. In this instance, the TSP component 84 is at the top end face. The top face is planar and at right angles with respect to the drawing die passage 95. It is constructed with the passage 95 emerging at the center top face surrounded by the diamond material. The passage 95 is located initially in the diamond material so that the great bulk of the wear and tear from the drawing process is inflicted on the diamond portion, not the body 92. The body 92 provides a larger dimension to enable the drawing die to be locked into the drawing apparatus. Moreover the diamond component 94, to the extent that it may be brittle, is reinforced by the surrounding hard metal body 92. In the embodiments 70, 80 and 90, the hard metal body is preferably formed of WC in a cobalt alloy described earlier, and the TSP component on the interior is fabricated in the same fashion as set forth before. The mix of ingredients to make the two components involved in the drawing die is the same as set forth for the embodiments shown in FIG. 1. As before, they can be fabricated in a one or two step process. In the two step process, preferably using microwave sintering, the diamond component is separately fabricated and sintered, and then is positioned in the mold while the hard metal body surrounding it is formed in the second step. In the alternate process, the diamond component is initially made by cold press assembly of the diamond particles and the binding metal alloy. That is held together with a sacrificial wax or other volatile adhesive which is vaporized during sintering. The sintering construction then forms the diamond region within the hard metal region. It is then a unitary device formed in a single sintering process step.

ADDITIONAL ALTERNATIVE EMBODIMENTS

Figure 11A:
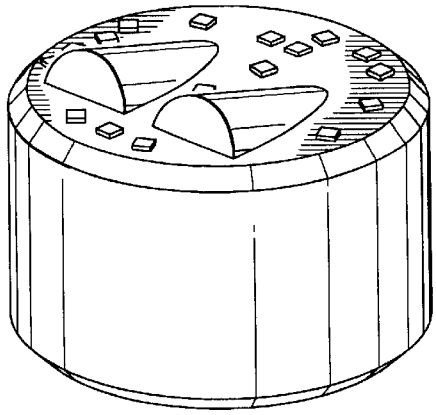
FIGS. 11A, 11B and 11C show various TSP reinforced wear parts, cutting inserts, or drill bit teeth further including diamond grit reinforcements in the body thereof.
Figure 11B:
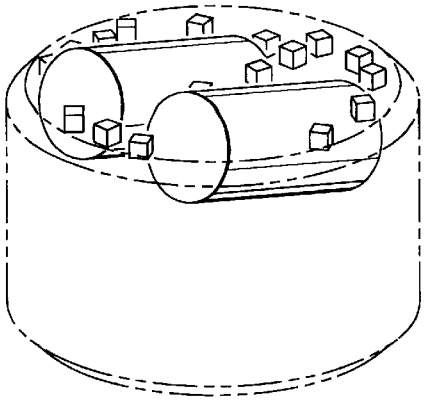
Figure 11C:
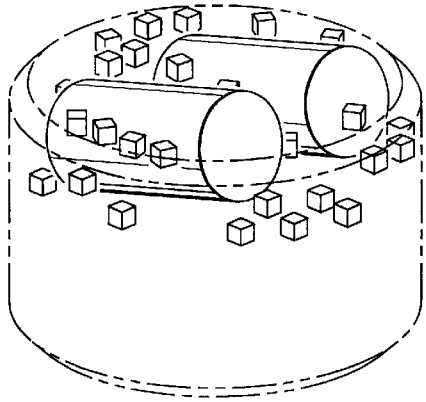

Attention is directed jointly to FIGS. 11A, 11B and 11C. In all instances, a cylindrical insert body is illustrated. In all three instances, it is constructed of the materials mentioned above. Effectively, it is some type of carbide body. The preferred material is WC in a cobalt alloy although other metals can be used including nickel and other metals instead of tungsten as the carbide compound. In addition to that, it is made of small particles of the hard material which are held together by the metal alloy binding material. In one aspect, it should be noted that alternative materials can be used although tungsten carbide is preferred. It is preferred because it is relatively hard and is more readily available than most hard compounds. A number of good vendors for WC are available. It is possible also to use nitrides. An example of this is CBN or cubic boron nitride. Again, there tends to be a readily available supply of CBN which can be ground or otherwise broken, converted into particles and integrated into the body. In general terms, and especially in the claims which are appended to the present disclosure, reference to carbide normally points out that preferred compound which is WC, but other metals have been exemplified herein. The term also, however, includes other hard materials such as the above mentioned CBN and other nitrides.

FIGS. 11A, 11B and 11C again show the respective thermally stable diamond regions. They are again formed of diamond particles. To give a representative set of dimensions, it is not uncommon to make the insert shown in this disclosure with a diameter of 0.529 inches with a height of about 0.315 inches. With that size, one or two of the cylindrical diamond based inserts can be integrated in it. The reinforcing from that component is normally comprised of right cylinders which measure about 3.5 mm by 5.0 mm, and can be as large as about 6.08 mm by 6.0 mm. With the smaller size, typically two can be arranged in the insert exemplified above (a body of about 13.4 mm with a height of about 8 mm). This is a readily implemented insert construction with TSP cylinders built in. Again, they are all formed integrally so that appropriate bonding is accomplished. Moreover, the TSD regions are extremely durable when held in this fashion. This overcomes the brittle nature of diamond and takes advantage of the hardness of diamond material. In effect, the brittleness of diamond material is compensated for by this type of construction.

FIGS. 11A, 11B and 11C differ primarily in the orientation of the TSD cylinders. In addition, however, they differ by further incorporating small pieces of diamond grit which are randomly distributed in the body. The diamond grit is represented by cubic symbols in the drawings, but it is appreciated that the graphic representation is more of an approximation rather than a literal depiction of relative size or regularity in structure. Diamond grit particles are collectively mixed into the WC making up the body. These grit particles are classified. Where smaller, they are preferably used in fashioning the TSD components. Larger grit particles are randomly mixed into the WC matrix. They are bound with it at the time of sintering. The cubic representation best shows their placement, but it does not show relative size or precisely depict diamond grit particle shape. That shape is a good deal more random. The diamond grit particles are classified. As noted, small particles go into the TSD while the larger particles are mixed in the carbide; commonly, these comprise grit particles less than 1 mm in diameter. The precise precision, number, and angular orientation is highly variable.

The diamond grit particles are beneficial. They help in forming a more solid inset construction and one which is especially able to withstand stress, jarring and impact. The hardness is used to grade advantage.

Figure 12A:
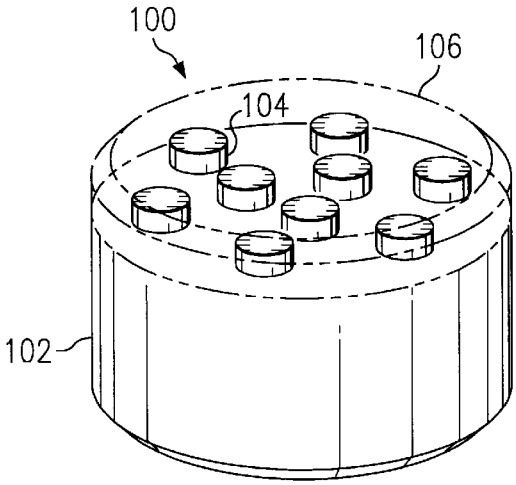
FIGS. 12A and 12B show TSP reinforced drill bit cutters where the TSP inserts have been covered over by a diamond layer applied on one end of the drill bit cutter.
Figure 12B:
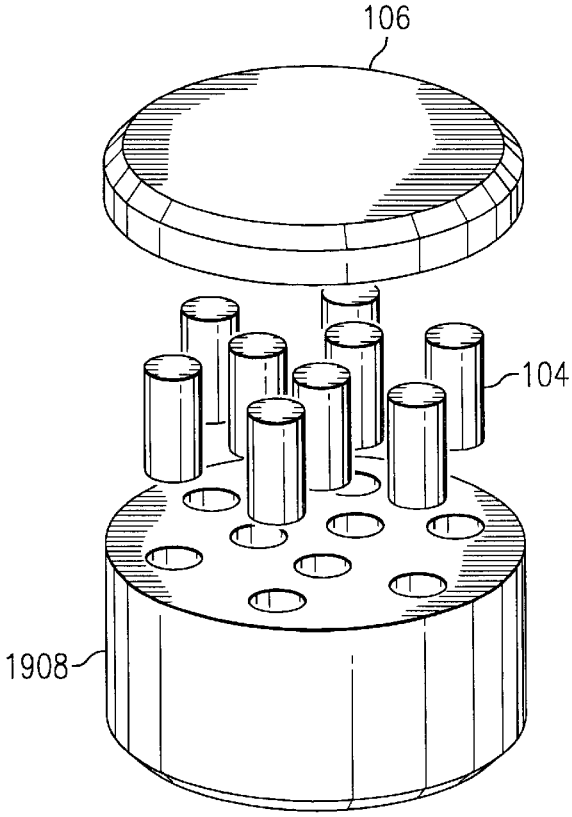

Attention is now directed to FIGS. 12A and 12B which both show a different insert construction. The insert shown in FIGS. 12A and 12B is constructed with the disclosed WC body. It has the shape of an elongate cylinder. In this particular instance, especially treating FIG. 12B as an exploded view, the insert is constructed with a set of TSP inserts in it. In this embodiment in particular, it is preferable to use about nine and they are arranged parallel to each other. Each of the nine is about 3.1 mm in diameter and about 5.5 mm in length. They are not merely housed, but are bonded into the surrounding insert body. At the upper end, a separate PDC layer is subsequently attached. Comparing FIGS. 12A to 12B, the PDC crown is typically flush mounted against the end face. More specifically, FIG. 12A shows the embodiment 100 comprising the WC insert body 102 and enclosing on the interior the integrally formed small TSP cylinders 104. At the top end, there is a PDC crown 106. In the embodiment 100, the PDC crown is formed in place over the end of the insert body and is therefore partially, but not fully, penetrated by several of the TSP cylinders 104. By contrast, all of the TSP cylinders 104 in common abut against the lower end of the face 106. In the exploded view arrangement, they do not need to extend into the end face 106.

For materials, the embodiments shown in FIGS. 12A and 12B again used the preferred form of WC particles in cobalt alloy in the insert body. The TSD inserts in it are formed as right cylinders and representative dimensions were given. They are covered over or integrally constructed with and bonded on the inside of the WC body and are below the PDC layer at the top end, the working end, or the wear end. The PDC layer is formed on the insert in a high pressure diamond press at high temperature in the diamond stable region after the microwave sintering of the substrate. The preferred WC insert body is formed by microwave sintering to create the major component. It is sintered around the TSP placed in the mold prior to sintering. This assures complete enclosure and bonding of the TSP, and also the diamond grit particles also. Microwave sintering reduces maximum temperatures and results in better product integrity and reduced diamond degradation.

While the forgoing is directed to the preferred embodiment, the scope thereof is determined by the claims which follow.

What is claimed is:

1. An insert comprising an elongate body having an exposed end face for wear wherein said body is formed of an alloy bonded metal carbide matrix, and including a thermally stable diamond region therein wherein the diamond region is formed of diamond with a binding metal alloy matrix and said diamond region comprises a curving surface on a side thereof away from the end face of the insert body.

2. The insert of claim 1 wherein said diamond region geometrically comprises at least one region having a discrete shape in said insert body and said shaped region is submerged fully in said insert body and has an outer surface fully within said body.

3. The insert of claim 2 wherein said shaped region is cylindrical.

4. The insert of claim 3 wherein two cylindrical diamond bodies are integrally formed in said insert body, and said bodies have parallel axes placed parallel to an end face of said insert.

5. The insert of claim 4 wherein said insert body is cylindrical having said end face and said end face is located to wear during use so that use wears away said end face and wears into said cylinders.

6. The insert of claim 5 wherein said diamond cylinders are exposed on wearing of said end face.

7. The insert of claim 6 wherein said insert body is cylindrical having a pair of opposing flat faces thereon to define a tapered insert.

8. The insert of claim 7 wherein said insert body is comprised of an alloy matrix binding plural carbide particles into a unitary structure.

9. The insert of claim 8 wherein said diamond cylinders are comprised of diamond particles joined together by a metal alloy primarily comprised of cobalt.

10. The insert of claim 9 wherein said carbide is tungsten carbide and comprises at least about 75 to about 94 percent and the remainder is comprised of a cobalt alloy wherein cobalt is from about 80 to about 96 percent of the alloy.

11. The insert of claim 10 wherein said diamond is comprised primarily of diamond particles joined with said metal alloy and said metal alloy and diamond particles are joined by a volatile sacrificial adhesive.

12. The insert of claim 3 wherein two cylindrical diamond bodies are integrally formed in said insert body, and said bodies have nonparallel axes disposed at a slant to an end face of said insert.

13. The insert of claim 1 further including plural diamond grit particles randomly described in said insert body.

14. The insert of claim 13 wherein said grit particles are concentrated near the thermally stable diamond grit particles.

15. The insert of claim 13 wherein said grit particles are bonded into said insert.

16. The insert of claim 1 wherein said diamond region comprises a surrounding carbide based, metal alloyed integrally cast die body enclosing said diamond region.

17. The insert of claim 1 wherein said elongate body is formed of said alloy, and said alloy is primarily metal consisting of cobalt, titanium, silicon or alloys thereof.

18. The insert of claim 1 wherein said insert is a drill bit insert fitting into a mounting on a drill bit.

19. The insert of claim 18 wherein said insert includes a PDC crown for cutting in a drag, roller or percussive drill bit.

20. The insert of claim 1 wherein said insert is an elongate cylindrical body fitting on a drill bit or stabilizer.

21. An insert comprising:

(a) a metal alloy bound hard material particulate matrix defining an elongated insert having an end exposed for wear and abrasion;

(b) a second end remote from said exposed end defining an elongate body therebetween;

(c) at least one thermally stable diamond region formed of diamond with a binding metal alloy matrix in said insert between said ends; and (d) an exposed end PDC layer bonded together thereto crowning said end having an alloy bonded diamond particulate composition so that said PDC layer provides a wear region on said inserts;

wherein said PDC layer covers over said at least one thermally stable diamond region and said insert.

22. The insert of claim 21 wherein a precursor substrate of carbide with thermally stable diamond body(s) is performed by microwave sintering, and a PDC layer is subsequently sintered on the substrate at about 1400° C. and 60 kilobars of pressure.

23. The insert of claim 21 wherein said alloy is primarily metal consisting of cobalt, titanium, silicon or alloys thereof.

24. An insert comprising an elongate body having an exposed end face for wear wherein said body is formed of an alloy bonded carbide matrix, and including at least two thermally stable diamond regions therein, and said diamond regions comprise curving surfaces on a side thereof away from the end face of the insert body whereby said diamond regions are discretely shaped and disposed in said insert body and said diamond regions have nonparallel axes disposed at a slant to an end face of said insert.

25. The insert of claim 24 wherein said insert further comprises an exposed end PDC layer bonded together thereto crowning said end having an alloy bonded diamond particulate composition so that said PDC layer provides a wear region on said inserts; and wherein said PDC layer covers over said thermally stable diamond regions and said insert.

26. An insert of claim 25 wherein the insert body has diamond grit particles embedded therein in addition to said diamond regions.

27. The insert of claim 24 wherein said diamond regions geometrically comprise at least one region having cylindrical shape in said insert body and said cylindrical shaped region is submerged fully in said insert body to form a microwave sintered insert body.

28. The insert of claim 27 wherein said end face is located to wear during use so that use wears away said end face and wears into said cylinders.

29. The insert of claim 28 wherein said diamond cylinders are exposed on wearing of said end face.

30. The insert of claim 29 wherein said insert body is cylindrical having a pair of opposing flat faces thereon to define a tapered insert.

31. The insert of claim 30 wherein said insert body is comprised of an alloy matrix binding plural carbide particles into a unitary structure.

32. The insert of claim 31 wherein said diamond cylinders are comprised of diamond particles joined together by a metal alloy primarily comprised of cobalt.

33. The insert of claim 32 wherein said carbide is tungsten carbide and comprises at least about 75 to about 94 percent and the remainder is comprised of a cobalt alloy wherein cobalt is from about 80 to about 96 percent of the alloy.

34. The insert of claim 33 wherein said diamond is comprised primarily of diamond particles joined with said metal alloy and said metal alloy and diamond particles are joined by a volatile sacrificial adhesive.

* * * * *